US007223332B1

(12) United States Patent
Tertel

(10) Patent No.: US 7,223,332 B1
(45) **Date of Patent: *May 29, 2007**

(54) REACTOR AND PROCESS FOR MERCAPTAN OXIDATION AND SEPARATION IN THE SAME VESSEL

(75) Inventor: Jonathan A. Tertel, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 463 days.

This patent is subject to a terminal disclaimer.

(21) Appl. No.: 10/690,353

(22) Filed: Oct. 21, 2003

(51) Int. Cl.
*C10G 17/00* (2006.01)
*B01D 43/00* (2006.01)
*B01D 11/04* (2006.01)

(52) U.S. Cl. ..... 208/208 R; 208/203; 208/207; 210/513; 210/538; 210/532.1; 422/256

(58) Field of Classification Search ..... 422/256; 296/14.52; 208/203, 207; 210/513, 538, 210/532.1
See application file for complete search history.

(56) References Cited

U.S. PATENT DOCUMENTS 2,390,296 A * 12/1945 Gilbert ..... 208/203
2,608,522 A * 8/1952 Niehaus, Jr. et al. ..... 208/203
2,853,432 A 9/1958 Gleim et al. ..... 196/32
3,216,927 A * 11/1965 Dresser ..... 208/284
3,923,645 A 12/1975 Anderson, Jr. et al. ..... 208/206
4,019,869 A 4/1977 Morris ..... 23/288 R
4,048,097 A 9/1977 Douglas ..... 252/431 N
4,049,572 A 9/1977 Douglas ..... 252/431 N
4,157,312 A 6/1979 Frame ..... 252/428
4,199,440 A * 4/1980 Verachtert ..... 208/230
4,481,106 A 11/1984 Verachtert ..... 208/206
4,923,596 A 5/1990 Bricker et al. ..... 208/207
5,674,378 A * 10/1997 Kraemer et al. ..... 208/233
5,961,819 A 10/1999 Lee et al. ..... 208/230

OTHER PUBLICATIONS

Kirk-Othmer, Encyclopedia of Chemical Technology (3d ed. 1981) vol. 15, 749-53.
Handbook of Petroleum Refining Processes, 11.31-.33 (Robert A. Meyers 2d ed. 1996).
Hydrocarbon Processing, Apr. 1982, p. 124.

* cited by examiner

*Primary Examiner*—Glenn Caldarola
*Assistant Examiner*—John Douglas
(74) *Attorney, Agent, or Firm*—James C. Paschall

(57) ABSTRACT

The present invention is an apparatus and process for oxidizing mercaptans in a preferably kerosene stream. By using a catalyst promoter, sufficient separation of hydrocarbon and aqueous alkali occurs in the reactor vessel to obviate the need for a settling tank. Hence, the sweetened kerosene can be withdrawn from the reactor vessel and sent directly to a residual alkali removal unit such as a sand filter vessel or to a water wash vessel if jet grade fuel is desired. In an embodiment, the reactor vessel used for this purpose includes a reaction section and a separation section in the same reactor vessel and an aqueous alkali outlet and a sweetened hydrocarbon outlet in the separation section.

19 Claims, 2 Drawing Sheets

REACTOR AND PROCESS FOR MERCAPTAN OXIDATION AND SEPARATION IN THE SAME VESSEL

FIELD OF THE INVENTION

The invention relates to a process and apparatus for converting mercaptan compounds in a kerosene hydrocarbon stream to disulfide compounds in the presence of an aqueous alkaline solution. Specifically, the invention relates to a process and apparatus in which the conversion of mercaptans and the separation of treated kerosene hydrocarbons containing disulfide compounds and aqueous alkaline solution occur in the reactor vessel without the need for a settling tank.

BACKGROUND OF THE INVENTION

The invention relates to a hydrocarbon treating process referred to as sweetening. In this process, mercaptans present in a liquid hydrocarbon stream such as naphtha or kerosene are oxidized in the presence of an aqueous alkaline solution to disulfide compounds which remain in the hydrocarbon stream. The sweetening of sour petroleum fractions is a well developed commercial process which is employed in almost all petroleum refineries. In this process, mercaptans present in the feed hydrocarbon stream are converted to disulfide compounds which remain in the hydrocarbon stream. Sweetening processes, therefore, do not remove sulfur from the hydrocarbon feed stream but convert it to an acceptable form. The sweetening process involves the admixture of an oxygen supply stream, typically air, to the hydrocarbon stream to supply the required oxygen. The admixture of hydrocarbon and air contact an oxidation catalyst in an aqueous alkaline environment. The oxidation catalyst may be impregnated on a solid composite or may be dispersed or dissolved in the aqueous alkaline solution. A commonly employed oxidation catalyst comprises a metal phthalocyanine compound impregnated on activated charcoal. A suitable catalyst is described in U.S. Pat. No. 4,049,572.

Unfortunately, the aqueous alkaline solution is neutralized over time by acidic components of the hydrocarbon stream, requiring its continued replacement and replenishment. This is especially true for certain feedstocks, such as kerosene, which typically have a significant content of naphthenic acids. Naphthenic acids are carboxylic acids found in petroleum and various petroleum fractions during refining. See Kirk-Othmer, Encyclopedia of Chemical technology (3d ed. 1981) Vol. 15, 749–53. Naphthenic acids are predominantly monocarboxylic acids having one or more cycloaliphatic groups alkylated in various positions with short chain aliphatic groups and containing a polyalkylene chain terminating in the carboxylic acid function. Although cyclopentane rings are the predominant cycloaliphatic ring structure, other cycloaliphatics rings, such as cyclohexanes, also may be present in appreciable quantities. The naphthenic acid content of feedstocks such as kerosene engenders further complications arising from the limited solubility of alkali metal naphthenates in concentrated alkali. Insoluble alkali metal naphthenates tend to plug beds of alkaline wetted oxidation catalyst. To avoid this, kerosene and kerosene range feedstocks undergo a caustic prewash to remove naphthenic acids prior to entry of the feedstock to the fixed bed. The solubility of the alkali metal naphthenates are such that their efficient extraction from kerosene range feedstocks into aqueous media requires prewash by a dilute caustic, with a concentration usually under 3 wt-%.

Two mercaptan oxidation sweetening processes employing fixed catalyst beds are described in D. L. Holbrook, Handbook of Petroleum Refining Processes, 11.31–.33 (Robert A. Meyers 2d ed. 1996). The first described process is fixed-bed sweetening which may be employed for heavier feedstocks having endpoints above 120° C. (248° F.) such as kerosene or jet fuel. The heavier feedstocks are only slightly soluble in caustic and hence more difficult to sweeten. Moreover, the heavier feedstocks have a density that is closer to that of the typically caustic alkaline solution which makes separation of sweetened hydrocarbon from the alkaline solution more difficult. Fixed-bed sweetening employs a reactor that contains a bed of activated charcoal impregnated with mercaptan oxidation catalyst and periodically wetted with aqueous caustic solution. Air is injected into the feed before entry into the reactor. The catalyst oxidizes the mercaptans in the feed to disulfides. A single outlet conducts the product hydrocarbon stream and aqueous caustic to a settler in which the hydrocarbon phase and aqueous caustic phase are separated. Caustic is withdrawn from the bottom of the settler periodically and circulated over the catalyst bed to maintain alkalinity. The catalyst bed is rinsed with aqueous caustic about once a day for up to half an hour to clean the pores of the catalyst and to alkalinize the catalyst bed. Greater amounts of aqueous caustic must be circulated over the catalyst bed for kerosene applications because more aqueous caustic is needed to solubilize the less soluble kerosene range hydrocarbons and to clean the pores of the catalyst in which the larger kerosene molecules tend to become lodged. The large volume of caustic is conducted to the settling tank to be pumped back to the reactor during the next rinse.

The second described process uses less equipment to sweeten lighter feeds such as catalytically cracked naphthas and light virgin naphthas. In this process, relatively weak aqueous caustic is continuously injected into a hydrocarbon feed previously freed of hydrogen disulfide. The caustic-hydrocarbon mixture is then mixed with air and delivered to a fixed catalyst bed in the reactor. The sweetened naphtha is removed near the bottom of the reactor above the hydrocarbon-caustic interface and caustic drains into a drain interface pot. The drain interface pot separates hydrocarbon from caustic and sends the former back to the reactor while the latter is treated and/or disposed. A similar process for fixed-bed sweetening of gasoline is shown at page 124 of the April, 1982 issue of Hydrocarbon Processing. A very small amount of the aqueous solution is continuously charged to the reactor vessel. The aqueous solution is then withdrawn from the bottom of the reactor vessel. However, the article indicates that a larger amount of more concentrated caustic must be intermittently recirculated over the catalyst requiring a settling tank to treat heavier hydrocarbon feeds, such as kerosene.

Continuous injection of alkaline solution into the mercaptan oxidation reactor with separation between the alkaline solution and the sweetened hydrocarbon in the same reactor has been proposed for treating heavier feeds. U.S. Pat. No. 4,481,106 discloses an apparatus for fixed bed sweetening which separates caustic and hydrocarbon phases in an annular separation zone separated by cylindrical screen from an inner catalyst bed. However, there has been concern that the volume of continuously injected alkaline solution necessary to sufficiently alkalinize a kerosene range hydrocarbon feed may be too great to effect separation in the reactor vessel.

Other mercaptan oxidation reactor vessels that include a discrete separation section have been proposed. U.S. Pat. No. 4,019,869 illustrates a reactor vessel that includes a catalyst bed resting on a horizontal support. Sweetened hydrocarbon is separated from aqueous caustic in the catalyst bed and delivered to a discrete subjacent portion of the reactor vessel. The aqueous alkaline-hydrocarbon interface is developed in subjacent portion of the reactor vessel to effect a second separation. U.S. Pat. No. 5,961,819 discloses a reactor vessel including a first downflow reaction zone over a fiber bundle that ends in a separator zone and a second upflow reaction zone over a mercaptan oxidation catalyst.

Sweetened kerosene reactor effluent from the settling tank is typically delivered to an alkali removing unit such as a salt filter or water wash vessel and then to a product tank. On the other hand, sweetened kerosene product must meet stricter specifications to be used as a jet fuel. To meet jet fuel specifications, oil-soluble surfactants must be removed from the sweetened kerosene. Such surfactants may be removed by running the sweetened kerosene through a residual surfactant removal device such as a clay filter. However, clay filters are sensitive to alkali. Hence, alkali remaining in sweetened kerosene must be removed such as by a water wash. Additionally, water must be removed from the kerosene in a residual water-removing device such as a salt filter before it is filtered in the clay filter. The amount of water in the kerosene effluent from the water wash is proportional to the salt that is consumed in the salt filter. Conventionally, water was batch replaced in the water wash vessel when the alkaline concentration in the water reached a high level necessitating greater labor and decreased separation efficiency during replacement. Additionally, because the water is mixed with the sweetened hydrocarbon in the water wash vessel, a greater proportion of water volume in the water wash vessel is necessary, thus diminishing the residence time of the hydrocarbon in the water wash vessel.

An object of the present invention is to provide a mercaptan oxidation apparatus and process for heavy hydrocarbon feed that includes a reaction section and a separation section in the same reactor vessel.

Another object of the present invention is to provide a mercaptan oxidation apparatus and process that obviates a settling tank after the reactor vessel.

SUMMARY OF THE INVENTION

The present invention is an apparatus and process for oxidizing mercaptans in a hydrocarbon stream. In an embodiment, the hydrocarbon feed comprises kerosene range hydrocarbons. By using a catalyst promoter, we have found that less volume of aqueous alkaline solution is needed to alkalinize the catalyst bed. Sufficient separation of hydrocarbon and aqueous alkali occurs in the reactor vessel to obviate the need for a settling tank. Hence, the sweetened kerosene can be withdrawn from the reactor vessel and sent directly to an alkali removal unit such as a sand filter or to a water wash vessel. In an embodiment, the reactor vessel used for this purpose includes a reaction section and a separation section in the same vessel and a process for oxidizing mercaptans in a hydrocarbon stream over catalyst in the presence of aqueous alkali and separating an aqueous alkali phase from a product hydrocarbon phase in the reactor vessel. In an embodiment, sour hydrocarbon feed mixed with oxygen, catalyst promoter and aqueous alkali is distributed to the top of the reactor vessel in a reaction section. The mixed feed contacts a catalyst bed supported above the bottom of the reactor vessel by a perforated shield. The catalyst oxidizes mercaptans in the feed to disulfides, thus, sweetening the hydrocarbon stream. Product hydrocarbons pass through the perforated shield from the reaction section into the separation section. An interface between the hydrocarbon phase and the aqueous alkaline phase develops in the separation section. A hydrocarbon outlet withdraws sweetened hydrocarbons including disulfides from the separation section, and an alkaline outlet withdraws aqueous alkali from the separation section. In an embodiment, a hydrocarbon product outlet is disposed above the aqueous alkaline outlet. In another embodiment, the aqueous alkaline outlet directly communicates with a drain pot vessel while the hydrocarbon outlet communicates with a residual alkaline removal unit.

DETAILED DESCRIPTION OF THE PREFERRED EMBODIMENTS

Figure 1:
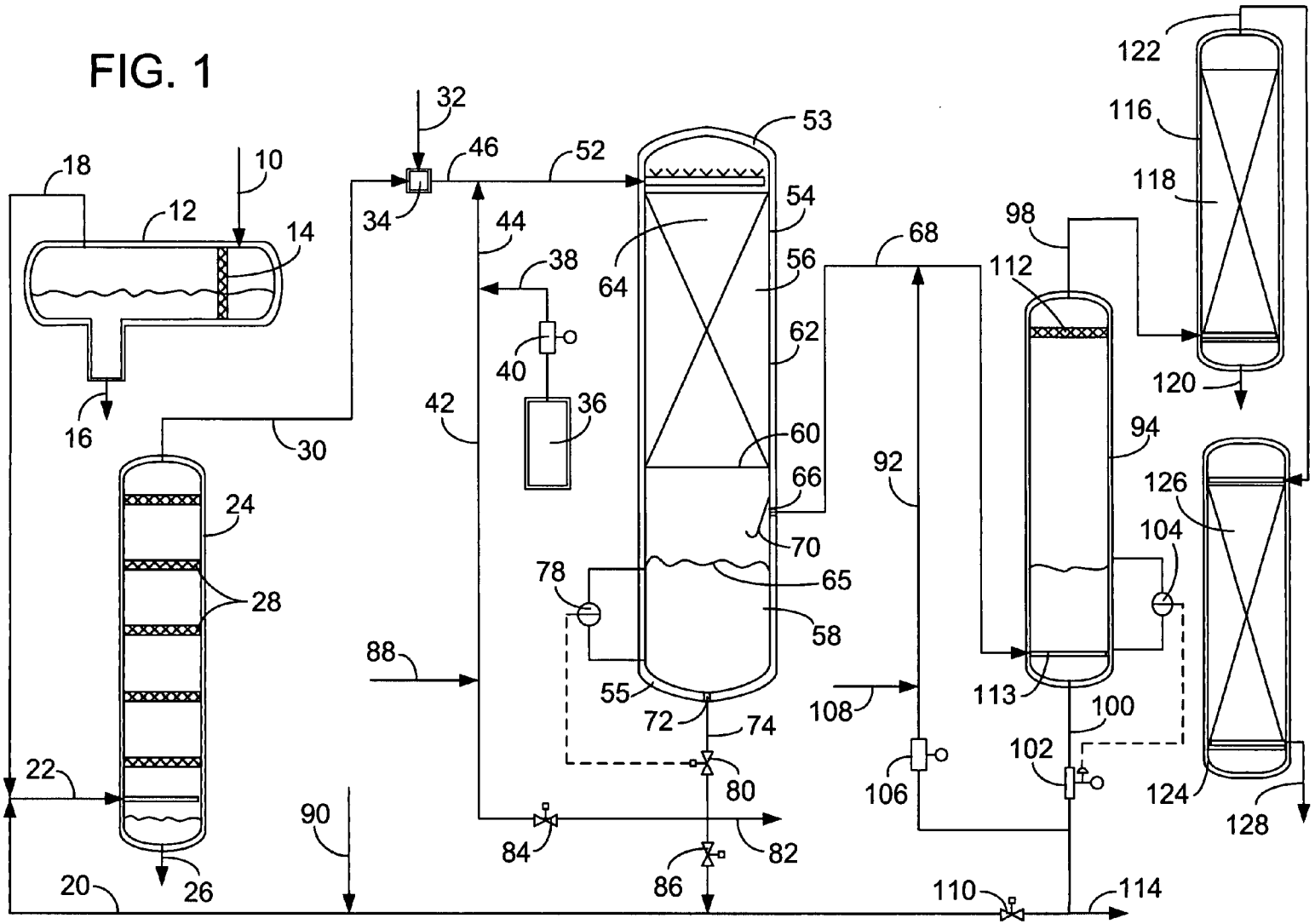
FIG. 1 is a schematic view of an embodiment of the present invention.

Although the subject apparatus and process may find application in a wide variety of uses, it is especially useful for performing a solid bed sweetening operation. In sweetening, the mercaptan compounds in a hydrocarbon stream are catalytically oxidized to disulfides in an alkaline environment. The disulfides remain in the product hydrocarbon stream.

The present invention is particularly useful to the sweetening of a kerosene boiling range hydrocarbon feedstock. The kerosene boiling range feedstock typically boils in the range from about 149° C. (300° F.) to about 300° C. (572° F.). These heavy feeds all typically contain abundant mercaptans as well as naphthenic acids.

To remove the naphthenic acids, the kerosene feed is typically prewashed with a weak aqueous alkaline stream, such as a 1.9 wt-% caustic solution to convert the naphthenic acids to sodium naphthenate salts. The naphthenate salt is attracted to the heavier aqueous alkaline stream which goes out the bottom of the prewash vessel while the lighter kerosene feed with a lower concentration of naphthenic acid exits the top. Screens in the prewash vessel may be used to facilitate coalescing of the drops of the aqueous alkaline solution to form heavier drops which will descend into the lower aqueous phase. In an embodiment, an electrostatic charge may be run over conductive screens to attract the ionic aqueous alkaline naphthenate salt solution to the screen to facilitate coalescence. The heavier coalesced drops of the aqueous alkaline naphthenate salt solution will drop to the bottom of the prewash vessel.

In an embodiment, the kerosene feed may be first conducted through a coalescer vessel to remove free water that may contain undesirable impurities left in the stream from an upstream refining process. The coalescer may include a screen that tends to agglomerate smaller droplets of water into larger droplets that will sink into the heavier aqueous phase.

In an embodiment of the sweetening process, an oxygen-containing stream is admixed with the sour feed stream to be presented to a fixed bed of oxidation catalyst. The oxygen-containing stream is preferably air. The rate of oxygen addition is set based on the mercaptan content of the sour feed hydrocarbon stream. The rate of oxygen addition is preferably greater than the amount required to oxidize all of the mercaptans contained in the feed stream, with oxygen feed rates of about 110 to about 220% of the stoichiometrically required amount being preferred. Oxygen typically supplied by air is admixed to the hydrocarbon feed stream through an air mixer. It is contemplated that the oxygen-containing stream may be delivered to the reactor separate from the sour feed.

An aqueous alkaline solution is also added to the oxidation catalyst by continuous addition, such as by admixture with the mixture of oxygen and sour hydrocarbon feed to the reactor vessel. The term "alkaline" herein is used to denote a basic solution with a pH over 7. The aqueous alkaline solution may comprise a solution of an alkaline metal hydroxide such as sodium hydroxide, commonly referred to as caustic, potassium hydroxide or ammonia. Any other suitable alkaline material may be employed if desired. An aqueous alkaline solution of about 1 to 3 wt-% caustic or about 0.5 to 2.0 wt-% ammonia may be added continuously or intermittently to the sour feed. If a prewash is used to remove most naphthenic acids from the sour feed, the flow rate of aqueous alkaline solution should be set to provide about 25 to 200 wppm and, in an embodiment, 30 to 70 wppm of alkaline on a hydrocarbon feed basis. If no prewash is used to remove naphthenic acids, the flow rate of aqueous alkaline solution should be increased proportionally to the concentration of naphthenic acids in the feed. Water may be additionally added to the feed stream in addition to the water added in the aqueous alkaline solution.

In an embodiment, a lower concentration of aqueous alkaline solution is necessary for the prewashing operation than in the sweetening reaction. Hence, injections of aqueous alkaline solution into the hydrocarbon feed may occur at the prewash step, most of which aqueous alkaline solution is removed from the feed stream, and/or prior to the reaction step. In an embodiment usually associated with using ammonia as the alkali, the stronger alkaline solution is admixed with the hydrocarbon feed prior to admixture with liquid catalyst promoter and oxygen. However, when caustic is used as the alkali, aqueous caustic is mixed with liquid catalyst promoter and combined with the kerosene feed after the kerosene is mixed with air. If no prewash vessel is utilized, the air may be mixed with the feed after the alkali and liquid catalyst promoter are mixed with the feed.

We have found that admixing a liquid mercaptan oxidation catalyst promoter with the feed to the reactor vessel obviates the need for a settling tank and in an embodiment facilitates the use of a single vessel for the reaction and separation steps. The liquid catalyst promoter may be dispersed or dissolved in the aqueous alkaline solution, in the hydrocarbon feed or in a mixture of both. Concentrations of 25 to 100 wppm of promoter with respect to the hydrocarbon feed is suitable for the present invention. Liquid catalyst promoter may serve to wash out the pores of the impregnated solid catalyst in the reaction section as well as promote the mercaptan oxidation reaction catalyzed by the supported catalyst. When heavier hydrocarbon feeds are used, such as kerosene, the liquid catalyst promoter may be necessary to clean out the pores that may be laden with the heavier hydrocarbons. Otherwise, greater volumes of aqueous alkaline solution must be rinsed over the catalyst to clean out the catalyst pores, which may necessitate the use of a settling tank. Use of the liquid catalyst promoter in addition to solid supported catalyst obviates the need for periodic rinsing or diminishes the volume of rinsing required of the catalyst bed with alkaline solution. With smaller volumes of aqueous alkaline solution in the reactor vessel, the separation between sweetened hydrocarbon phase and aqueous alkaline solution is more readily accomplished in the reactor vessel. The liquid mercaptan oxidation catalyst promoter is typically present in a container such as a drum and continuously pumped into the line carrying the aqueous alkaline solution before or after admixture with hydrocarbon feed. Although, the catalyst is most easily injected as a liquid into the liquid hydrocarbon feed, it may be administered in another state. If caustic is the alkali used, in an embodiment, a liquid catalyst promoter comprising a sulfonated metal phthalocyanine with a quaternary amine in caustic prepared according to the teachings of U.S. Pat. No. 4,157,312 and U.S. Pat. No. 4,048,097, which are incorporated herein by reference, may be used. In an embodiment, Merox Plus™ available from UOP LLC may be used if caustic is the alkali used. If ammonia is the alkali used, in an embodiment, a liquid catalyst promoter comprising a sulfonated metal phthalocyanine with a quaternary amine prepared according to the teachings of U.S. Pat. No. 4,049,572 and U.S. Pat. No. 4,048,097, which are incorporated herein by reference, may be used. In an embodiment, Merox CF™ available from UOP LLC may be used if ammonia is the alkali used. Other liquid mercaptan oxidation catalyst promoters may be suitable.

The feed mixture of hydrocarbon, aqueous alkali, catalyst and air are delivered to a reaction section of the reactor vessel. The feed mixture is spread over the catalyst bed by a distributor. The nozzles of the distributor may face away from the catalyst bed. The feed mixture is passed through the fixed bed of catalyst material. The bed of catalyst preferably has a cylindrical shape conforming to the inner surface of the process vessel, however, other shapes of the catalyst bed and reactor vessel may be suitable. In an embodiment, the liquid mixture travels downwardly through the catalyst bed. The desired oxidative condensation of the mercaptans converts them into disulfide compounds. The disulfide compounds dissolve in the hydrocarbon phase.

The catalyst bed may rest on the bottom end of the reactor vessel. If the reactor vessel employs a separation section, the reaction section is separated from the separation section by a perforated shield. The catalyst bed is supported by the perforated shield or screen which divides the reaction section from the separation section of the reactor vessel. The shield extends across the entire cross-section of the reactor vessel in an embodiment. All of the fluid entering the separation section from the reaction section passes through the perforated shield. The perforated shield allows the free flow of liquid into the separation zone while preventing substantial flow of the catalyst material. Some limited amount of catalyst material such as fines will leak through the perforated shield. A product mixture entering the separation section will have a higher concentration of disulfides and a lower concentration of mercaptans than the sour hydrocarbon stream fed to the reactor. The hydrocarbons flow into the separation section and then flow upwardly to a hydrocarbon outlet near the top of the separation section because the hydrocarbon phase is less dense than the aqueous alkaline phase. Hence, a hydrocarbon-alkaline interface develops in the separation section. In an embodiment, a baffle over the top of the hydrocarbon outlet prevents downflowing aqueous alkaline solution from entering into the hydrocarbon outlet.

An aqueous alkaline outlet at the bottom of the reactor vessel allows removal of the alkaline solution from the reactor vessel. The flow rate of alkaline solution out of the reactor vessel is controlled by a control valve which is governed by a level indicator controller to assure that the interface between the hydrocarbon and the aqueous alkaline solution does not rise up to the level of the hydrocarbon outlet. The aqueous alkaline solution can be either sent to further treatment, disposed of or, in some cases, recirculated to be admixed with the hydrocarbon feed line or the naphthenic acid prewash after augmentation with additional alkali. Fresh aqueous alkaline solution may supply all of the alkaline solution mixed with the hydrocarbon feed or supplement the recirculated alkaline solution admixed with the hydrocarbon feed.

In an alternative embodiment, instead of effecting separation of the hydrocarbon and aqueous alkaline phases in the reactor vessel, the aqueous outlet at the bottom of the reactor vessel can be fed to a drain pot vessel in which the hydrocarbon and aqueous alkaline phases are separated. Under such an alternative, a collector extending into the reactor vessel typically collects hydrocarbon descending through the reactor vessel. The collector has a porous surface which is sized to admit hydrocarbon thereinto and to prevent the admission of the descending heavier aqueous alkaline phase. The hydrocarbon withdrawn from the reactor vessel is then sent directly to a residual water removal device such as a sand filter or to a residual alkaline removal device such as a water wash vessel if it is to be processed to meet jet fuel grade. The aqueous alkaline phase is withdrawn through the bottom of the reactor vessel and sent to a drain pot vessel in which an interface between the hydrocarbon and the aqueous alkaline phases generates. It is important that this interface be disposed lower than the collector in the reactor vessel for withdrawing hydrocarbon phases. Therefore, the hydrocarbon collector will be sure of only collecting equilibrium amount of the aqueous alkaline phase with the predominant hydrocarbon phase. The level of the interface in the drain pot vessel is maintained by a level indicator controller. Hydrocarbon withdrawn from the top of the drain pot vessel is recirculated back to the reactor vessel while aqueous alkaline solution withdrawn from the bottom of the drain pot vessel is either recirculated back to the reactor vessel with the feed stream, recirculated back to the naphthenic prewash vessel or is disposed of after perhaps further treatment. By using a catalyst promoter, smaller volumes of aqueous alkaline solution are sufficiently separated from the hydrocarbon phase to obviate the need for a settling tank.

If employed, the perforated shield in the reactor vessel is preferably made from a rigid self-supporting metal screen. This screen can be fabricated by welding parallel face rods to perpendicular support or connecting rods. The face rods may have a flat protruding surface which faces inwardly toward the catalyst material. The perforated shield should be located at an elevation in the reactor vessel set to allow sufficient residence time below the shield for the product mixture to develop into hydrocarbon and aqueous phases.

A solid mercaptan oxidation catalyst is employed in the reaction section of the reactor vessel. The active catalyst component may be impregnated on solid particulates retained in a catalyst bed within the reaction section. Any commercially suitable mercaptan oxidation catalyst can be employed as the active component. For instance, U.S. Pat. No. 3,923,645 describes a catalyst comprising a metal compound of tetrapyridino-porphyrazine which is preferably retained on an inert granular support. The preferred catalyst is a metallic phthalocyanine such as described in the previously cited references and in U.S. Pat. No. 2,853,432; U.S. Pat. No. 4,049,572 and U.S. Pat. No. 4,923,596, all of which are incorporated by reference. The metal of the metallic phthalocyanine may be titanium, zinc, iron, manganese, etc. but is preferably either cobalt or vanadium, with cobalt being especially preferred. The metal phthalocyanine is preferably employed as a derivative compound. The commercially available sulfonated compounds such as cobalt phthalocyanine monosulfonate or cobalt phthalocyanine disulfonate are preferred, although other mono-, di-, tri-, and tetra-sulfo derivatives could be employed. Other derivatives including carboxylated derivatives, as prepared by the action of trichloroacetic acid on the metal phthalocyanine, can also be used if desired in the subject process.

The solid on which the active catalyst is supported in the bed is an inert absorbent carrier material. This carrier material may be in the form of tablets, extrudates, spheres, or randomly shaped naturally occurring pieces. Natural materials such as clays and silicates or refractory inorganic oxides may be used as the support material. The support may therefore be formed from diatomaceous earth, kieselguhr, kaolin, alumina, zirconia, etc. It is especially preferred that the catalyst comprises a carbon-containing support, particularly charcoals which have been thermally and/or chemically treated to yield a highly porous structure similar to activated carbon. The active catalytic material may be added to the support in any suitable manner, as by impregnation by dipping, followed by drying. The catalyst may also be formed in-situ within the reaction zone as described in the cited references. The finished catalyst preferably contains from about 0.1 to about 10 wt-% of a metal phthalocyanine. The solid or supported catalyst may comprise the only contact material which fills the reaction section of the reactor vessel or may be admixed with other solids. In an embodiment, Merox No. 8™ or Merox No. 10™, available from UOP LLC, may be used when caustic is the alkali component, and Merox No. 31™, also available from UOP LLC, may be used when ammonia is the alkali component. Both of these catalysts comprise the active component impregnated on carbon support.

The use of a packed bed reaction section provides quiescent admixture of the reactants for a definite residence time. Mechanical devices such as perforated plates or channeled mixers can also be used in conjunction with the contacting bed along with an inlet distributor. Contact times in the reaction section or reactor vessel are generally chosen to be equivalent to a liquid hourly space velocity based on hydrocarbon charge of about 1 to 70 or more. A contacting time within the catalyst bed in excess of 1 minute is desired. The sweetening process is generally performed at ambient (atmospheric) or slightly elevated temperatures. A temperature above about 10° C. (50° F.) and below about 149° C. (300° F.) is preferred. The pressure in the reaction section is not critical but is generally elevated to the extent necessary to prevent vaporization of the hydrocarbons and to achieve the solution of added oxygen and nitrogen in the hydrocarbons. The reaction section may be successfully operated at low pressures including atmospheric pressure. However, the subject process is directed to hydrocarbons having significant mercaptan contents and which therefore require substantially elevated pressures to achieve the desired gas solubility. For this reason, an elevated pressure above 1034 kPa (150 psig) may be used. Higher pressures up to 6895 kPa (1000 psig) or more can be employed, but increase the cost of the process and are not preferred unless required to promote liquid phase conditions.

If the hydrocarbon stream from the reactor vessel need not meet jet fuel specifications, it may be delivered via a conduit to a residual alkali removal unit such as a sand filter or a water wash vessel. If the sweetened hydrocarbon phase must meet jet fuel specifications, it must be run through a residual surfactant removal unit such as a clay filter vessel or other unit to remove oil-soluble surfactants. Clay filters are susceptible to alkali and water. Hence, the sweetened feed must be serially processed through a residual alkali removal unit to remove alkali and a residual water removal unit to remove water. The residual alkali removal unit used to generate jet fuel is most typically a water wash vessel. A residual alkali removal unit removes trace amounts of aqueous alkaline solution from a hydrocarbon phase as opposed to a settling tank which separates a substantial aqueous alkaline phase from a substantial hydrocarbon phase. A substantial phase is greater than 5 wt-%. A conduit directly communicating the hydrocarbon outlet of the reactor vessel to the residual alkali removal unit will include no intervening major process units such as a settling tank. In other words, no major process units will intervene between the hydrocarbon outlet and the residual alkali removal unit. Flow inlets, static mixers and outlets may, however, intervene in the conduit between the sweetened hydrocarbon outlet and the sand filter.

The sand filter typically used when jet fuel is not being produced consolidates remnants of the aqueous alkaline phase and removes them from the hydrocarbon phase. The sweetened kerosene product can thus be recovered such as by sending it to a product tank. If a water wash vessel is used, remaining alkali in the hydrocarbon phase is attracted to the water phase taken out of the bottom of the vessel. The hydrocarbon phase with a lower concentration of alkali exits the top of the water wash vessel. The water wash vessel may have a larger width than its height to generate a larger interfacial area to promote mixing and separation. However, by continuously admixing the water with the hydrocarbon in the line to the water wash vessel, mixing is accomplished prior to the delivery of feed to the water wash vessel. The level of water in the water wash vessel may be decreased by omitting the volume of water that would conventionally be needed to effect mixing. A greater proportion of the volume in the vessel is then provided for the hydrocarbon phase, thus increasing the hydrocarbon residence time and separation efficiency. Consequently, less water is included in the hydrocarbon effluent from the water wash vessel which must be removed, thus consuming less salt in the salt filter vessel if used as the residual water removal unit. A level indicator controller may be used to control the outlet flow rate of the aqueous phase to maintain the desired water level. Moreover, the diameter of the vessel may be decreased to be smaller than the height because the large interfacial area is no longer needed for mixing. Hence, a water wash column may be used as the water wash vessel to remove alkali from sweetened hydrocarbon. The continuous addition of water to the water wash vessel obviates the labor-intensive batch replacement of water conventionally in practice in water wash vessels. The hydrocarbon effluent out the top of the water wash vessel may then be run through a residual water removal unit such as a salt filter vessel to remove residual water and then to a surfactant removal unit such as a clay filter vessel to remove oil-soluble surfactants to obtain jet grade fuel.

The effluent water from the water wash vessel has a very small concentration of alkali and may be recirculated to be admixed with sweetened hydrocarbon in the line to the water wash vessel and reused. Make up water may need to be added to the water recirculation line. The effluent water from the water wash vessel may also be recirculated to the naphthenic prewash vessel after the alkaline concentration of the effluent is augmented to the appropriate level. This water recirculation and reuse decreases the amount of water that must be treated and/or disposed.

DETAILED DESCRIPTION OF THE DRAWING

The following description details an embodiment of the present invention which would be most advantageously used when caustic is employed as alkali. The hydrocarbon feed stream is carried in a line 10 to a coalescer 12. A screen 14 in the coalescer 12 serves to agglomerate aqueous drops that may carry impurities from the upstream refining process. Water drops out of the coalescer 12 in a line 16 while the dewatered hydrocarbon feed is carried by a line 18 to be admixed with a weak aqueous alkaline solution delivered by a line 20. The admixture is carried by a line 22 and distributed into a naphthenic acid prewash vessel 24. Contact between the aqueous alkaline solution and the naphthenic acids produces naphthenic salts which are removed with the aqueous phase in a line 26. The hydrocarbon phase travels upwardly in the prewash vessel 24. In an embodiment, screens 28 in the prewash vessel 24 coalesces aqueous droplets together to increase their weight so they fall to the bottom of the prewash vessel 24. A charge may be run over the screens 28 to attract the ionic aqueous naphthenic salt solution to facilitate coalescence. A hydrocarbon phase lean on naphthenic acid is removed by a line 30 and admixed with an air stream from a line 32 in an air mixer 34. A liquid mercaptan oxidation catalyst promoter from a container such as a drum 36 is pumped through a line 38 by a pump 40 to be admixed with an aqueous alkaline solution in a line 42. A mixture of aqueous alkaline solution and liquid catalyst promoter in a line 44 is admixed with the aerated hydrocarbon mixture in a line 46. A line 52 carries the complete mixture and distributes it to a mercaptan oxidation reactor vessel 54. The mercaptan oxidation reactor vessel 54 includes two sections. A reaction section 56 is separated from a separation section 58 by a shield 60. The shield 60 extends across the entire lateral cross-section of the reactor vessel 54 in an embodiment. If the reactor vessel 54 is cylindrical, the circumference of the shield 60 is supported on one cylindrical wall 62 of the reactor vessel 54. If the reactor vessel 54 is not cylindrical, edges of each side of the shield 60 are supported on the corresponding wall of the reactor vessel 54. A top end 53 of the reactor vessel 54 partially defines the reaction section 56 and a bottom end 55 partially defines the separation section 58. A bed 64 of catalyst is supported on the shield 60. The shield 60 is permeable to fluid flow but substantially prevents the catalyst from falling into the separation section 58. However, catalyst fines that have dimensions smaller than openings in the shield 60 may travel from the reaction section 56 to the separation section 58. In an embodiment, the reaction section 56 is above the separation section 58 to provide for downflow of feed through the reactor vessel 54. In a further embodiment, a distributor in the reactor vessel 54 has nozzles directed away from the catalyst bed 64. In an embodiment, the shield 60 may be configured such that all of the fluid in the reaction section 56 must flow through the shield 60 to enter the separation section 58. In the reaction section 56, mercaptans in the hydrocarbon stream are oxidized to disulfides in a sweetening process. In the separation section 58, the sweetened hydrocarbon stream including the disulfides separate from the aqueous alkaline solution which has a heavier specific gravity. An interface 65 develops in the separation section 58 between the hydrocarbon phase and the aqueous alkaline phase. A hydrocarbon outlet 66 permits withdrawal of the sweetened hydrocarbon phase through a line or conduit 68. A baffle 70 comprising an upper portion defining a partial cone and a lower hook lip shields the hydrocarbon outlet 66 from descending alkali solution.

Consequently, only hydrocarbon which ascends with respect to the aqueous alkali along with perhaps an equilibrium amount of alkaline solution will enter into the hydrocarbon outlet 66. An alkaline outlet 72 allows aqueous alkaline solution to be withdrawn through a line 74. A level indicator controller 78 governs a control valve 80 on the line 74 to regulate the flow rate through the alkaline outlet 72. The flow rate is controlled to maintain the interface between the hydrocarbon and alkaline phases below the hydrocarbon outlet 66. The alkaline solution removed through the line 74 can either be taken to further treatment and disposal through a line 82 or, if desired, recirculated through the line 42 back to the reactor vessel 54, depending on the setting of a control valve 84, or recirculated through the line 20 to the naphthenic acid prewash vessel 24, depending on the setting of a control valve 86. Lines 88 and 90 provide fresh aqueous alkaline solution to the lines 42 and 20, respectively, as necessary to augment the recirculated streams in those lines to the necessary concentration or to provide all of the aqueous alkaline solution to one or both of those lines if one or both of the control valves 84 and 86, respectively, are set at zero. Hence, the alkaline line 42 can either be fed by the recirculated alkaline solution from the line 74, by fresh alkaline solution through the line 88 or by both. Moreover, the line 20 can either be fed by the recirculated alkaline solution from the line 74, by fresh alkaline solution through the line 90 or by both. Because the separation between the aqueous alkaline solution and the sweetened hydrocarbon phases take place in the separation section 58 in the reactor vessel 54, the sweetened kerosene in the conduit 68 need not be taken to a settling tank. The hydrocarbon outlet 66 is directly communicated to an inlet to the residual alkali removal unit by the conduit 68. The conduit 68 extends from the hydrocarbon outlet 66 to a distributor or other inlet device of a residual alkali removal unit. If the sweetened kerosene will not be used for jet fuel, the sweetened kerosene in the conduit 68 may be directly delivered to a residual alkali removal unit such as a sand filter (not shown) to coalesce and drop out remaining aqueous alkaline solution from the sweetened kerosene. Alternatively, if the sweetened kerosene will be used for jet fuel, the sweetened kerosene in the conduit 68 must be purified of oil-soluble surfactants. To do this, the sweetened hydrocarbon from outlet 66 is delivered directly to a residual alkali removal unit such as a water wash vessel which may be a water wash column 94. Water from a line 92 is admixed with the sweetened kerosene in the conduit 68. The mixture of water and sweetened kerosene is then distributed through a distributor 113 to the water wash column 94. In the water wash column 94, remaining aqueous alkaline solution in the sweetened hydrocarbon phase drops into the aqueous phase. The aqueous phase is heavier and goes to the bottom of the water wash column 94. The sweetened hydrocarbon phases are removed through a line 98. A screen 112 in the top of the water wash column 94 serves to coalesce water droplets to increase their weight and encourage them to drop downwardly into the aqueous phase. The aqueous phase is removed through a line 100 governed by a control pump 102 regulated by a level indicator controller 104. The level indicator controller 104 maintains a predetermined water level at the hydrocarbon/aqueous interface. Some and likely most of the aqueous effluent in the line 100 will be recirculated through the line 92 and assisted by a pump 106 back to the conduit 68 to be admixed with the sweetened kerosene in route to the water wash column 94. Make up water is added by a line 108 to the line 92. Some, none or all of the aqueous effluent in the line 100 not withdrawn in the line 92 may be admixed with the stream in the line 20 as regulated by a control valve 110. The aqueous effluent not admitted to the line 20 or the line 92 will be discarded through a line 114.

The sweetened hydrocarbon phase in the line 98 will be delivered to a salt filter vessel 116. A salt bed 118 in the salt filter vessel 116 dissolves in the water remaining in the hydrocarbon phase and the heavier brine solution accumulates to form bigger drops that fall to the bottom of the salt filter vessel 116 to be removed in a line 120. The hydrocarbon phase with a minimal water content is removed through the top of the salt filter vessel 116 in a line 122 and distributed to the top of a clay filter vessel 124. As the hydrocarbon runs through the clay filter vessel 124, the clay in a clay bed 126 absorbs the oil-soluble surfactants while the jet fuel grade kerosene is removed through a line 128 from the bottom of the clay filter vessel 124.

Figure 2:
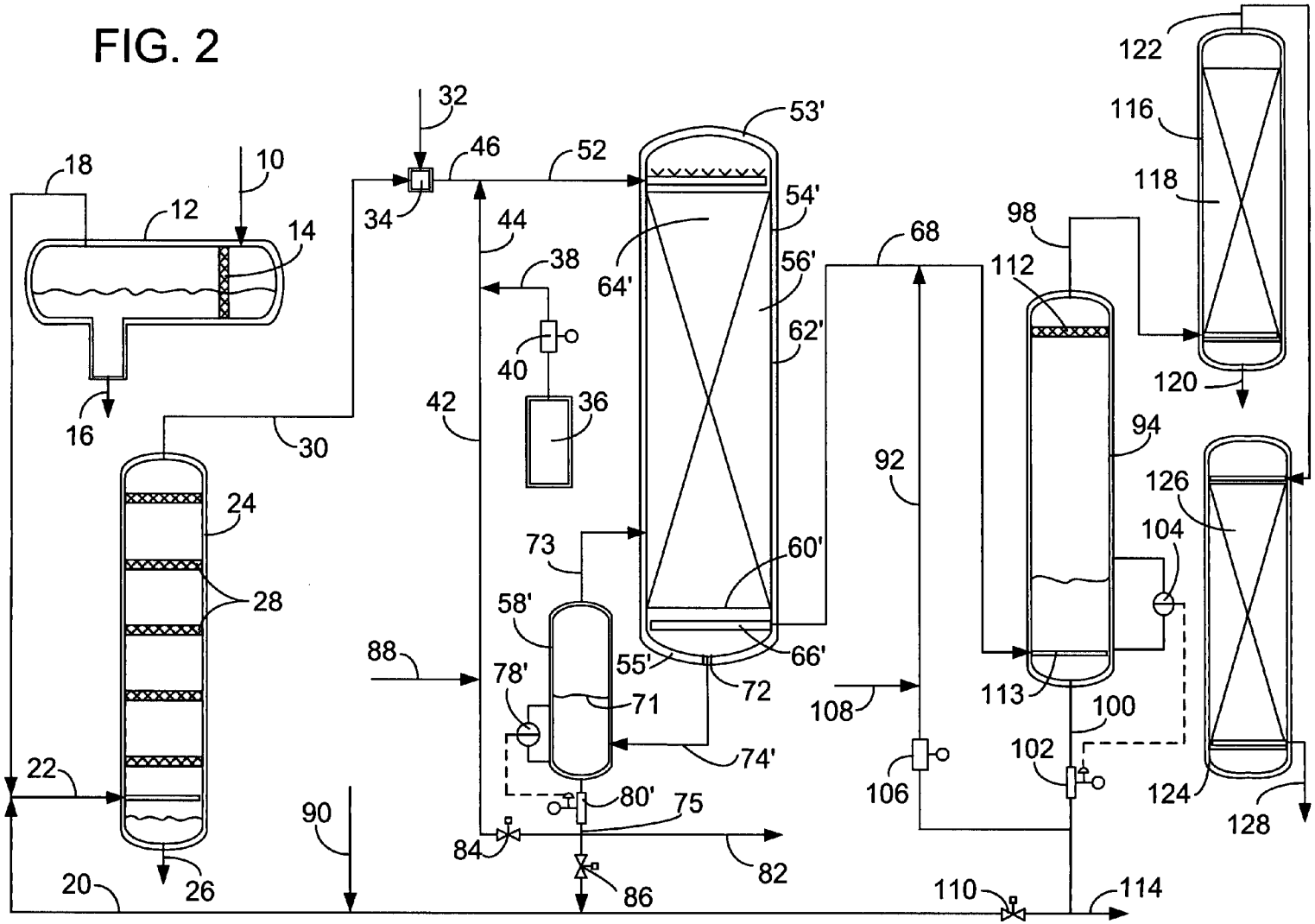
FIG. 2 is a schematic view of an alternative embodiment of the present invention.

In an alternative embodiment shown in FIG. 2, instead of having the reaction section 56 and the separation section 58, the reactor vessel 54' defined by a cylindrical wall 62' may include only a reaction section 56' with a top end 53' and a bottom end 55' and further separation occurs in a drain pot vessel 58'. FIG. 2 is very similar to FIG. 1 with most differences having to do with the reactor vessel 54' and the drain pot vessel 58'. All elements in FIG. 2 that have a different configuration than the same corresponding element in FIG. 1 have been designated with a prime symbol (').

Otherwise, elements of FIG. 1 and FIG. 2 having the same reference numeral will generally have the same configuration. Hence, discussion of FIG. 2 is limited to the reactor vessel 54' and the drain pot vessel 58'. Sour hydrocarbon feed from which naphthenic acids have been removed and mixed with air promoter in an aqueous alkaline solution are fed to the reactor vessel 54' through a distributor at the end of the line 52. The reaction section 56' includes a solid mercaptan oxidation catalyst bed 64'. The catalyst bed 64' may extend to the bottom end of the reactor vessel 54'. A collector 66' may be supported on a concrete floor at the bottom end 55' of the reactor vessel 54' and disposed in the catalyst bed 64'. The collector 66' typically comprises pipes with porous surfaces that withdraw hydrocarbon from the reactor vessel 54' while allowing the aqueous alkaline solution to descend below the collector 66' through an alkaline outlet 72. The hydrocarbon phase withdrawn through the collector 66' enters the conduit 68 and is further processed as explained with respect to FIG. 1. A line 74' carries the aqueous alkaline phase to the drain pot vessel 58' where further separation between hydrocarbon and aqueous phases occurs. In the drain pot vessel 58', an interface 71 generates between the lighter hydrocarbon phase and the heavier aqueous phase. The hydrocarbon phase is withdrawn through a line 73 and recycled back to the reactor vessel 54' whereas a line 75 withdraws the aqueous phase from the bottom of the drain pot vessel 58'. A level indicator controller 78' which governs a control valve 80' assures that the interface 71 in the drain pot vessel 58' stays below the collector 66' in the reactor vessel 54'. This will assure that any hydrocarbon/aqueous interface that develops in the reactor vessel 54' will be below the collector 66', so predominantly hydrocarbon will be withdrawn from the reactor vessel 54'. The control valves 84, 86 will control how much of the aqueous alkaline solution will be circulated back to the reactor vessel 54' via the lines 42 and 52, how much of the aqueous alkaline solution will be recirculated back to the prewash vessel 24 and how much of the aqueous alkaline solution will be discarded through the line 82.

What is claimed is:

1. An apparatus for the conversion of mercaptans comprising:

a reactor vessel comprising:

a first end and a second end;

at least one inlet for delivering a feed including hydrocarbons containing mercaptans, oxygen and aqueous alkaline solution to said reactor vessel;

a first end defining a reaction section and a second end of said reactor vessel defining a separation section and a fluid permeable shield extending across an entire lateral cross section of said reactor vessel, said shield for supporting a solid catalyst thereabove, a first side of said fluid permeable shield partially defining said reaction section and a second side of said fluid permeable shield partially defining said separation section;

a hydrocarbon outlet for withdrawing a sweetened hydrocarbon stream from said separation section, said hydrocarbon outlet being positioned between said fluid permeable shield and said second end of said reactor vessel; and an aqueous alkaline outlet for withdrawing predominantly aqueous alkaline solution from said reactor vessel, said aqueous alkaline outlet being positioned closer to said second end than said hydrocarbon outlet;

an outlet conduit in communication with said hydrocarbon outlet; and a residual alkaline removal unit in communication with said outlet conduit.

2. The apparatus of claim 1 wherein said residual alkaline removal unit is a water wash column.

3. The apparatus of claim 1 wherein all of said fluid passing from said reaction section to said separation section passes through a fluid permeable shield.

4. The apparatus of claim 3 wherein said fluid permeable shield is positioned between said inlet and said second end of said vessel.

5. The apparatus of claim 1 further comprising a drain pot vessel in communication with an aqueous alkaline outlet.

6. The apparatus of claim 5 wherein an aqueous recycle line returns aqueous alkaline solution from said drain pot vessel back to said reactor vessel.

7. The apparatus of claim 1 wherein said residual alkaline removal unit is a sand filter vessel.

8. The apparatus of claim 1 further including a baffle between said inlet and said hydrocarbon outlet.

9. The apparatus of claim 1 further including a collector protruding into said reactor vessel in communication with said hydrocarbon outlet.

10. A process for converting mercaptans comprising:

mixing a hydrocarbon feed having an initial boiling point of at least 300° F. containing mercaptans with a catalyst promoter;

delivering said hydrocarbon feed and said catalyst promoter to a reaction section of a reactor vessel;

delivering an aqueous alkaline solution and oxygen to said reaction section;

contacting said hydrocarbon feed containing mercaptans with a bed of oxidation catalyst on a solid support to produce a hydrocarbon product with a lower concentration of mercaptans than in said hydrocarbon feed, said bed of catalyst being supported on a fluid permeable shield;

passing all of said hydrocarbon product and aqueous alkaline solution through said fluid permeable shield to a separation section of said reactor vessel, said reaction section being disposed above said separation section and said shield extending across the entire lateral cross-section of the reactor vessel;

generating an interface between said hydrocarbon product and said aqueous alkaline solution with a hydrocarbon side and an aqueous alkaline side of said interface;

withdrawing hydrocarbon product from said hydrocarbon side of said interface; and withdrawing aqueous alkaline solution from said aqueous alkaline side of said interface.

11. The process of claim 10 further comprising passing said hydrocarbon product to a residual alkaline removal unit.

12. The process of claim 11 wherein said residual alkaline removal unit is a water wash column and further comprising adding water to said hydrocarbon product before it enters said water wash column to mix said hydrocarbon product and said water before entering said water wash column.

13. The process of claim 10 wherein said catalyst promoter is a liquid.

14. The process of claim 10 wherein said hydrocarbon feed, said oxygen, said catalyst promoter and said aqueous alkaline solution are all mixed together before entering said reactor vessel.

15. The process of claim 10 further including subjecting said hydrocarbon product to a water wash without first undergoing settling.

16. A process for converting mercaptans comprising:

contacting a hydrocarbon feed containing mercaptans and naphthenic acids with a first aqueous alkaline solution to convert said naphthenic acids to salts and remove said salts from said hydrocarbon feed;

delivering said hydrocarbon feed having a reduced concentration of naphthenic acid and a catalyst promoter to a reaction section of a reactor vessel;

delivering a second aqueous alkaline solution and oxygen to said reaction section;

contacting said hydrocarbon feed containing mercaptans and aqueous alkaline solution with a bed of oxidation catalyst on a solid support in the presence of an aqueous alkaline solution to produce a hydrocarbon product with a lower concentration of mercaptans than in said hydrocarbon feed, said bed of catalyst being supported on a fluid permeable shield;

passing all of said hydrocarbon product and said aqueous alkaline solution through said fluid permeable shield to a separation section of said reactor vessel, said reaction section being disposed above said separation section and said shield extending across the entire lateral cross-section of the reactor vessel;

generating an interface between said hydrocarbon product and said aqueous alkaline solution with a hydrocarbon side and an aqueous alkaline side of said interface;

withdrawing hydrocarbon product from said hydrocarbon side of said interface; and withdrawing aqueous alkaline solution from said aqueous alkaline side of said interface.

17. The process of claim 16 wherein at least one of said second aqueous alkaline solution and said catalyst promoter are continuously added to said reactor vessel.

18. The process of claim 17 wherein at least one of said second aqueous alkaline solution and said catalyst promoter are continuously added to said hydrocarbon feed before delivery to said reactor vessel.

19. An apparatus for the conversion of mercaptans comprising:

a reactor vessel comprising a first end defining a reaction section and a second end defining a separation section;

at least one inlet for delivering a feed including hydrocarbons containing mercaptans, oxygen and aqueous alkaline solution to said reaction section of said vessel;

a fluid permeable shield to support solid catalyst thereabove, a first side of said fluid permeable shield partially defining said reaction section and a second side of said fluid permeable shield partially defining said separation section;

a hydrocarbon outlet for withdrawing a predominantly hydrocarbon stream from said separation section of said vessel, said hydrocarbon outlet being positioned between said fluid permeable shield and said second end of said vessel; and an aqueous alkaline outlet for withdrawing predominantly aqueous alkali from said separation section of said vessel, said aqueous alkaline outlet being positioned closer to said second end than said hydrocarbon outlet;

an outlet conduit in communication with said hydrocarbon outlet; and a water wash column in communication with said outlet conduit.

* * * * *